US005392753A

United States Patent [19]

Burson et al.

[11] Patent Number: 5,392,753

[45] Date of Patent: Feb. 28, 1995

[54] MICROPROCESSOR CONTROLLED CAPACITOR DISCHARGE IGNITION SYSTEM

[75] Inventors: Bob O. Burson, Vernon; James A. Herndon, Suffield, both of Conn.

[73] Assignee: R. E. Phelon Company, Inc., Aiken, S.C.

[21] Appl. No.: 155,384

[22] Filed: Nov. 22, 1993

[51] Int. Cl.[6] ..... F02P 1/08; F02P 5/15

[52] U.S. Cl. ..... 123/600; 123/602

[58] Field of Search ..... 123/416, 417, 418, 478, 123/600, 599, 602

[56] References Cited

U.S. PATENT DOCUMENTS

| | | | |
|---|---|---|---|
| 4,566,425 | 1/1986 | Nitou et al. | 123/600 |
| 4,620,521 | 11/1986 | Henderson et al. | 123/602 X |
| 4,757,797 | 7/1988 | Bengtsson | 123/602 |
| 4,924,831 | 5/1990 | Piteo et al. | 123/602 X |
| 5,161,496 | 11/1992 | Matsushima et al. | 123/478 X |
| 5,170,760 | 12/1992 | Yamada et al. | 123/602 X |

*Primary Examiner*—Willis R. Wolfe
*Attorney, Agent, or Firm*—Chapin, Neal & Dempsey

[57] ABSTRACT

Capacitor discharge ignition system having a microprocessor disposed thereon to control the ignition timing of the system. The system has a generator coil, a primary coil and a secondary coil on the same leg portion of a ferromagnetic core. An electronic circuit associated with the microprocessor includes a capacitor adapted to be charged by an intermediate pulse generated by the charge coil with the leading and trailing pulses thereof being input to control the operation of the microprocessor. The circuit also includes an SCR having its anode-cathode path connected in circuit with the capacitor and primary coil and its gate connected to an output port of the microprocessor which also includes an input port to power the microprocessor from the charge coil. Another port of the microprocessor is adapted to receive timing reference inputs from the charge coil. The microprocessor is programmed to send a signal to the SCR that causes the capacitor to discharge through the primary and thereby induce an ignition pulse in the secondary. In addition, the microprocessor is programmed to be cut "off" and remain "off" for the duration of the ignition pulse.

5 Claims, 2 Drawing Sheets

MICROPROCESSOR CONTROLLED CAPACITOR DISCHARGE IGNITION SYSTEM

BACKGROUND OF THE INVENTION

This invention relates to capacitor discharge ignition systems controlled by a microprocessor for small engines and more particularly to an improvement in such systems which not only overcomes the problems of the prior art but does so at a substantial reduction in materials costs.

U.S. Pat. No. 4,924,831 (831 Patent), dated May 25,1990, and assigned to the same assignee as this application, discloses generally the same type of compact system as the present invention. The '831 Patent discloses the use of a relatively costly optocoupler device for electrically connecting the ignition system to the microprocessor although no explanation is given in the patent for selecting this type of coupling device in the system. It has been learned, however, that if a conventional connection is substituted for the infrared emitting diode and light sensing switch of the optocoupler used in the '831 Patent to lower substantially the materials costs of the system, that serious operating difficulties are encountered related to ignition pulse "noise" being picked up by the microprocessor. This was the same problem the '831 Patent sought to overcome but since cost of such small engine systems of the type embodying this invention is of such a paramount importance in that highly competitive marketplace, another solution had to be found to solve the "noise" disruption problem in the operation of the microprocessor.

It is therefore the principal object of this invention to provide an improved capacitor discharge ignition (CDI) system in combination with a digital timing control unit that is simpler, more economical and reliable than similar systems heretofore available.

The above and other objects and advantages of this system will be more readily apparent from the following description read in conjunction with the accompanying drawings in which.

Figure 1:
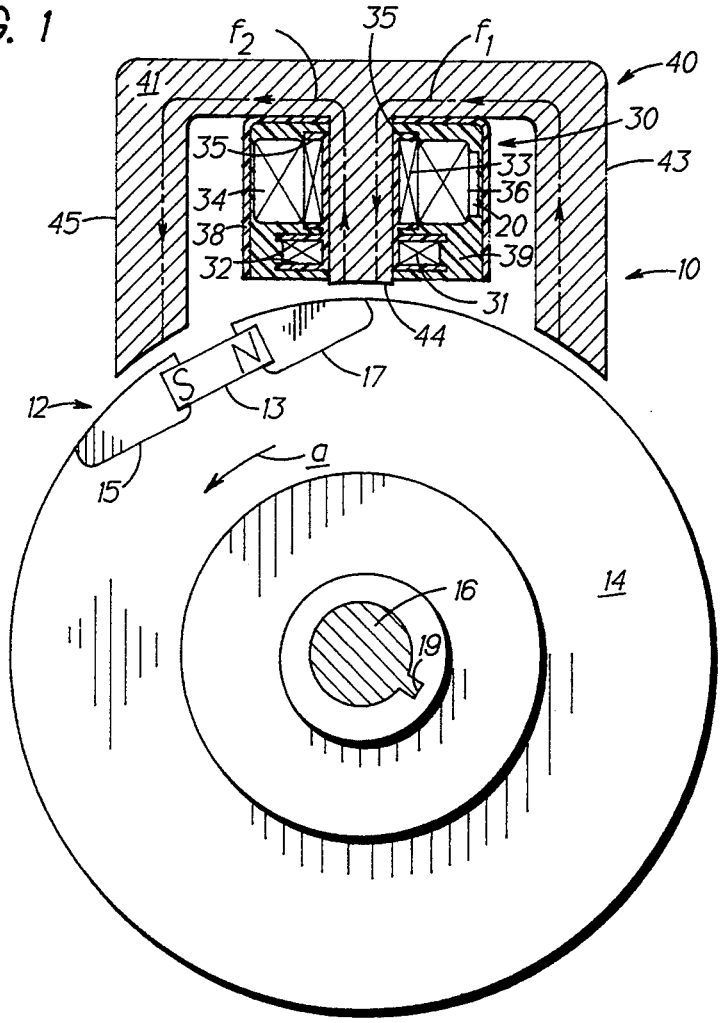
FIG. 1 is an elevational view partly in section of a magnetomotive device of the type embodying this invention.

In FIG. 1, is shown a stator unit 10 and a permanent magnet assembly 12 disposed in the rim of a flywheel 14 fitted onto and rotatable with shaft 16 of an internal combustion engine and has a keyway 19 at a predetermined angular position relative to the magnet group. As a result, the shaft 17, such as the crankshaft or camshaft, will rotate in synchronism with the operation of the intemal combustion engine so that movement of the magnet assembly 12 past a given point of the stator core is timed in physical relation to the top dead center position of the crank-arm driven by the engine. The timing of the ignition system is controlled by a printed circuit board 20 disposed in contiguous relation with or close proximity to a unitary coil construction 30 disposed on one leg portion of a laminated ferromagnetic core 40. The printed circuit 20 is shown in greater detail in FIG. 3 and will hereinafter be more fully described in conjunction therewith.

The magnet group 12 comprises a permanent magnet 13 that is disposed with its poles oriented to engage a pair of ferromagnetic pole pieces 15 and 17. Since the flywheel 14 is a non-magnetic material, such as an Aluminum casting, magnetic lines of flux emitted by the magnet 13 will be concentrated in the pole pieces for coupling to the leg portions of the core 40 as the magnet group is rotated thereby.

The core 40 comprises a cross-bar portion 41 and a plurality of leg portions 43, 44 and 45. The core 40 will generally have either two or three leg portions depending on whether the core is being used on a two or four cycle engine and, in any case, is preferably fabricated of a multilaminar construction. In the embodiment shown, the coil 30 and control circuit board 20 are disposed on the same leg portion 44 which is also the middle leg of a three leg core 40.

Since it is well known that the generation of electrical energy in the windings of a generator coil, as at 31, is a function of the tums of the coil "cutting" the magnetic lines of flux. In a three leg core construction 40, it is thus important to mount the generator coil, or charge coil 31, on the central leg 44. With this arrangement, a complete flux reversal, as illustrated by flux lines at $f_1$ and $f_2$, occurs in leg 44 as the pole pieces 15 and 17 of the magnet group are carried by the counterclockwise rotatable flywheel, as indicated by arrow a, first past legs 43 and 44 and then past legs 44 and 45. This results in a complete reversal of flux in the middle leg caused by the collapse of flux in one direction and the subsequent build-up of the lines of flux in the opposite direction and results in the maximum number of lines of flux being "cut" by the windings of the charge coil 31.

Figure 3:
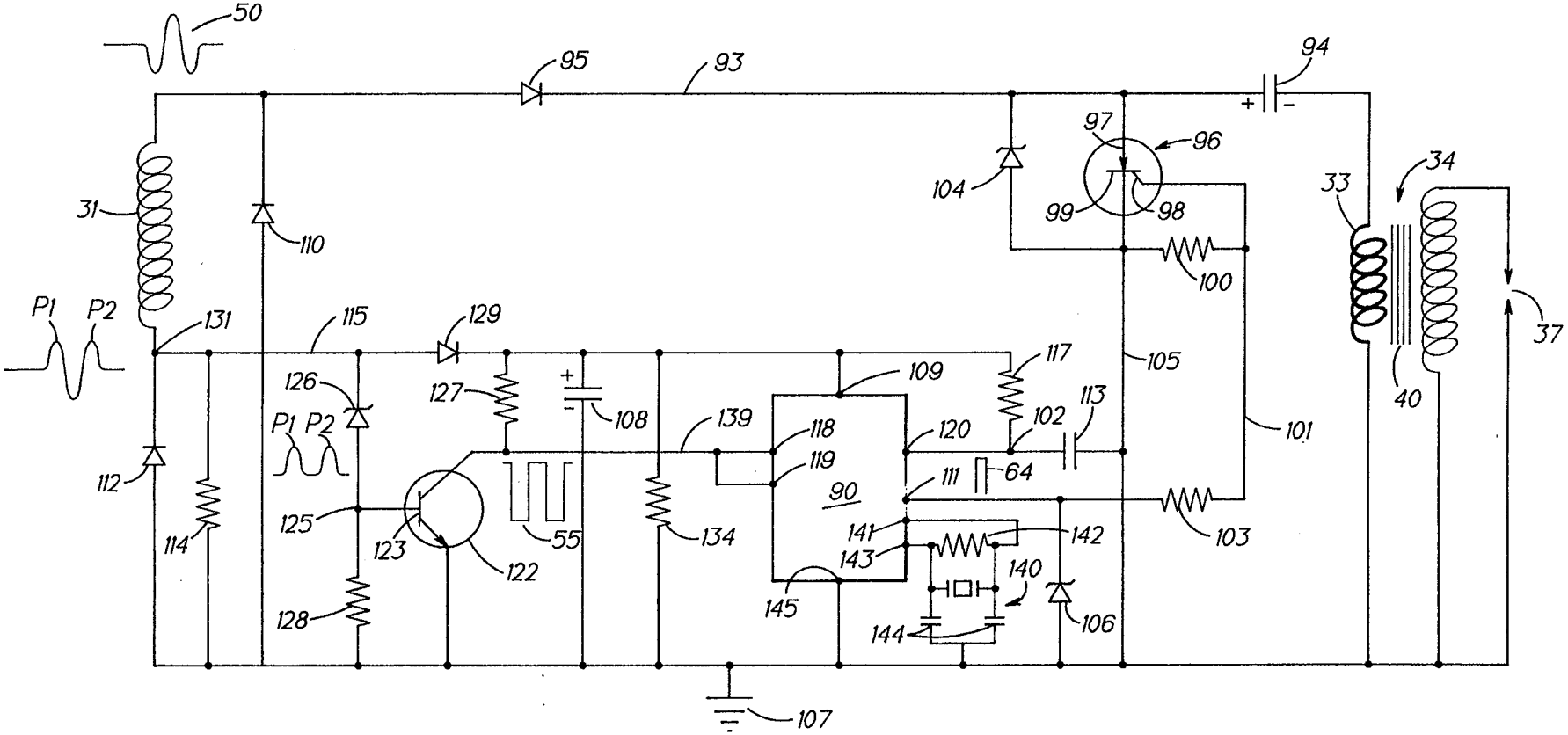
FIG. 3 is a schematic wiring diagram of the ignition system of the type embodying the invention.

A unitary coil construction 30, as shown in FIG. 1, comprises a double bobbin arrangement including a pair of axially spaced, outer flanges 32, between which the charge coil 31 is wound and a second pair of similarly spaced flanges 35, between which the primary 33 is wound. The charge coil 31 is thus disposed adjacent the outer end of the leg 44 so that it will be in close proximity to the magnet group for close coupling therewith. The primary winding 33 of the ignition coil 34 will thus be spaced, in the radial sense, slightly inward from the charge coil 31 for minimum mutual magnetic coupling therewith. The secondary winding 36 of the ignition coil 34 is fitted closely about the primary winding 33 for maximum inductive coupling between those two coils and is connected to a spark gap device or spark plug 37 and ground 107 as shown in FIG. 3. The printed circuit 20 is interconnected with the ignition system by a simple terminal pin arrangement, not shown. As is the conventional practice in fabricating such coil arrangements, the entire assembly is disposed in a plastic cup-shaped housing 38 and the coils and printed circuit board are encapsulated in a suitable epoxy resin 39 for moisture and weather proofing, enhanced performance and maximum service life of the system.

Figure 2:
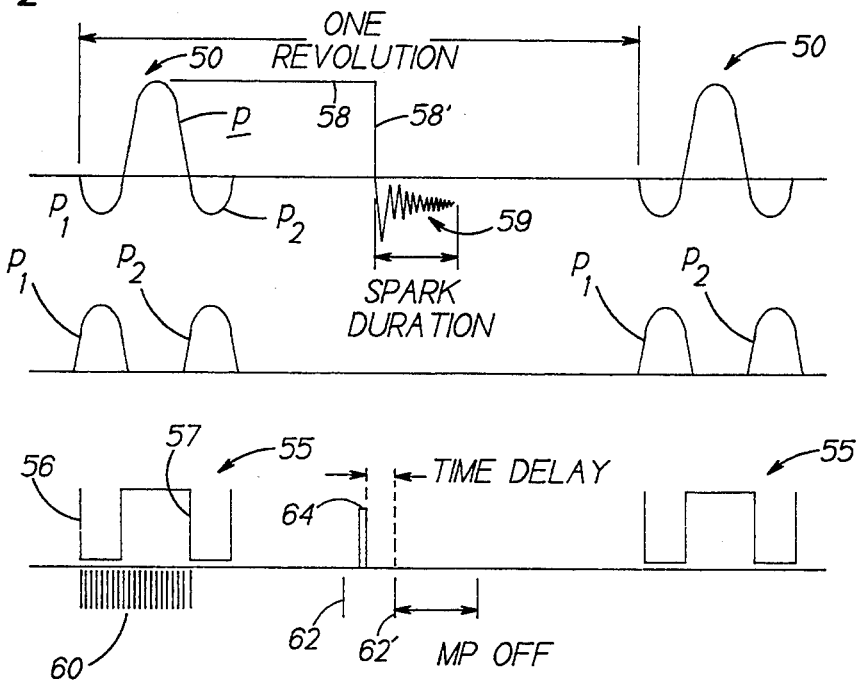
FIG. 2 is a graphic showing which illustrates wave forms of the type generated in the operation of the system.

The charge coil 31 is wound in a direction such that for each revolution of the magnet group 12 past the core 40, a voltage 50 will be generated in the charge coil 31 which, as shown in FIG. 2, comprises a positive main pulse p and two smaller magnitude, negative side pulses $p_1$ and $p_2$. The wave shapes are illustrated in the graphs in FIG. 2 in which the ordinate thereof is the amplitude of electrical energy and the abscissa is a time line. The larger positive polarity pulse p is used to charge the capacitor 94 of the ignition system while at the opposite end of the charge coil 31, the two side pulses $p_1$ and $p_2$ are, with reference to ground 107 of positive potential. These pulses are used to energize the microprocessor 90 and also to provide the processor unit input reference signals 55 which will hereinafter be described, derived from the pulses $p_1$ and $p_2$.

Equi-spaced timing pulses 55 are used in the microprocessor 90, as illustrated at 60 in FIG. 2 where they are shown between the leading edge 56 of the first pulse 55 and the leading edge 57 of the second pulse 55. The spacing between the leading edges of the two pulses is a function of the rotational speed or rpm of the engine shaft 16 and the flywheel 14 and the number of timing pulses 60 counted by the microprocessor will be inversely proportional to the rotational speed of the engine. Those timing pulse counts are used for establishing a time line or basis used in the microprocessor 90 for operation of the program, or stored data, of the most efficient spark advances for various rotational speeds of the particular engine on which the system is to be used. Programmed in that way and based upon the actual engine rpm, the microprocessor will output a signal which will cause the ignition system to generate an ignition pulse for the most efficient engine operation. The computer program or software may be based upon a curve of spark advance versus rotational speeds of the engine with the microprocessor being programmed to utilize a plurality of straight line segments or increments disposed in end-to-end tangential relationship along the curve. For each such segment which corresponds to a range of pre-determined changes in the rotational speed of the engine, the microprocessor is programmed to output a corresponding change in the ignition timing to provide the requisite advance of the ignition timing for each such segment or increment thereof.

When the charge stored on capacitor 94 of the CDI system as indicated at 58 in FIG. 2, is discharged as at 58' through the primary winding, the result is an ignition pulse generated across the spark plug 37 (FIG. 3) by the secondary winding, as illustrated at 59 in FIG. 2. The ignition pulse 59 is of such magnitude and duration as to cause substantial interference heard as "noise" by the microprocessor 90 so as to adversely affect the operation of the microprocessor.

In accordance with this invention, the micro-processor 90 is programmed to generate a command during each revolution of the flywheel 14 to "shut off" all its input ports for a predetermined time. That time is preferably at least as long as the duration of the ignition pulse 59 generated by the particular ignition coil 30 used in the system that embodies this invention. In that way, the microprocessor will not pick up or "hear" the "noise" generated by the ignition pulse so that the ignition pulses will not interfere with the operation of the microprocessor 90. The command may be given at any time during a time interval that may run from just prior to the microprocessor sending out a signal or pulse of electric energy 64 to the SCR 96 to turn the same "on" or after the signal 64 has been sent out by the processor, as will be hereafter discussed in greater detail. The time interval may extend from a time, as represented at 62 in FIG. 2, which would be prior to the signal 64 having been sent out, to a time, as represented at 62', after the signal has been sent out but before the start of the ignition pulse 59. As a result of the output signal 64 being sent out by the microprocessor 90, the SCR 96 will be triggered "on" whereby the ignition pulse 59 will be generated, as will hereinafter be more fully described. The amount of time, in microseconds, from the generation of the output signal 64 to the generation of the ignition pulse, can range anywhere from about 10 to 50 microseconds, depending upon the time to fire the SCR 96 and the rise time of the voltage across the secondary winding of the ignition coil. This time interval is represented in FIG. 2 as a "time delay". Further, the length of time of the "shut off" of the microprocessor is programmed to be at least as long and preferably substantially longer than the spark duration 59. It is important only that the microprocessor be turned back "on" prior to the next cycle of operation, such as when the flywheel has completed a revolution and the magnet group has rotated around for the next cycle of magnetic interaction with the coil/core group 10.

A CDI system, of the type embodying this invention, is shown in FIG. 3 and the relationship between the various components of the printed circuit 20 and the microprocessor 90 which is a part thereof, will be described in connection therewith. The system comprises the generator, or charging coil 31 which provides electrical energy in the form of a pulse 12 to charge the capacitor 94 of the CDI system during each revolution of the engine shaft. The charge coil 31 also provides electrical energy to power the microprocessor 90 which may be a Motorola MC68HC05J1 and to provide signals or external interrupts concerning engine operating speeds to initiate a programmed response.

As the flywheel 20 rotates in synchronism with the shaft 16 of an internal combustion engine, pulses 50 of electrical energy will be generated in the charge coil 31. Assuming a three leg core arrangement, as shown in FIG. 1, the capacitor 94 will be charged by a larger positive pulse p, FIG. 2. The pulse p charges the capacitor 94 via a charging diode 95, poled to pass only positive pulses whereby the capacitor 94 will be charged to a polarity, as illustrated at 58 in FIG. 2.

An electronic switching means in the form of a silicon controlled rectifier (SCR) 96 includes an anode 97, cathode 99 and gate electrode 98. The anode-cathode junction is connected by a conductor 105, from conductor 93 to ground 107 across the primary winding 33 of the ignition coil 34, while the gate electrode 98 is connected by a conductor 101 to output terminal or port 111 of the microprocessor 90. A biasing resistor 100 for gate 98 is connected from conductor 101 via conductor 105 to ground 107. A Zener diode 104 is connected from conductor 105 to conductor 93 and serves as a ring-back path for the primary winding 33 and the capacitor 94 which provides an AC spark for the ignition system. The Zener 104 also protects the gate of the SCR 96 and capacitor 94 against excessively high voltages. Similarly, limiting resistor 103 in the conductor or circuit 101 and Zener diode 106 connected to ground, limit the output of the microprocessor 90 to a predetermined value which, in the embodiment being described, is on the order of 5 volts. These components also serve to protect the microprocessor against high voltage feedback surges from the ignition circuit.

A Diode 110 is connected across charge coil 31 from conductor 93 to ground 107 to ensure that the main positive pulse p will be isolated from ground potential while diode 112 serves to prevent the positive side pulses $p_1$ and $p_2$ at junction 131 from being short circuited to ground. Resistor 114 is disposed across diode 112 and is connected from conductor 115 to ground 107 to ensure that a substantial potential difference will be maintained across conductor 115 and ground 107. Pulses $p_1$ and $p_2$ will thus be available to charge capacitor 108 which provides a DC power supply for the microprocessor at its inlet port or terminal 109; the pulses also serve as the basis for providing input reference signals or interrupts to the microprocessor. A resistor 134 is connected in parallel with capacitor 108 from conductor 115 to ground to provide a discharge path for the capacitors 108 and 113 when the system is turned "off".

At the lower end of the coil 31 is a junction 13 1 that interconnects coil 31 to the cathode side of diode 112 and to conductor 115. A transistor 122 which, in this embodiment is a NPN type, has collector and emitter electrodes connected respectively from conductor 115 to ground 107 with the base electrode 123 thereof connected to junction 125 between a Zener diode 126 and a resistor 128. A load resistor 127 is disposed across the collector of transistor 122 and conductor 115 to bias the emitter to a relatively high predetermined voltage level, such as 5 volts, when the transistor is in its high impedance mode, or its collector-emitter junction is "off". A charging diode 129, poled to pass positive pulses, ensures that electrical energy of positive pulses $p_1$ and $p_2$ with respect to ground, will charge capacitor 108. When the transistor 122 is turned "on" by a base-emitter current, the collector-emitter junction becomes conductive whereby the transistor 122 is changed from its high impedance to is low impedance mode. As a result, the high voltage on the collector is, in effect, shunted to ground 107 so that pulses $p_1$ and $p_2$ are both amplified and squared, as illustrated at 55 in FIG. 2 and in FIG. 3, adjacent conductor 139 which extends from the collector of transistor 122 to input ports 118 and 119 of the microprocessor 90.

From junction 131, the positive pulses $p_1$ and $p_2$ are connected by diode 129 in conductor 115 to the positive side of capacitor 108 to input port, or terminal 109 of the microprocessor 90 and via resistor 117 to a reset terminal 120 of the processor unit 90, which reset is operative only after the ignition system has been "turned off" and is then restarted. A capacitor 113 is connected, on one side thereof, to grounded conductor 105, and on its other side, is connected to junction 102 between terminal 120 and resistor 117. The capacitor 113 and resistor 117 provide a time delay network to prevent resetting of the microprocessor 90 until the capacitor 108 has had an opportunity to become fully charged to a predetermined voltage of approximately 5 volts, for example. From the collector electrode of transistor 122, a conductor 139 connects to input ports, or pins 118 and 119, of the microprocessor and based upon elapsed time between the leading edges 56 and 57 of the two pulses 55 (FIG. 2) continuously provides to the microprocessor input engine rpm references. As a result, the microprocessor is capable of determining the requisite spark advance for each particular ignition coil in which the printed circuit 20 and microprocessor 90 is disposed in accordance with this invention.

In the embodiment shown, a ceramic resonator 140, energized by the microprocessor 90, is connected to pins 141 and 143 of the microprocessor, provides the timing pulses, as at 60 in FIG. 2, to the microprocessor 90. A load resistor 142 is connected across the resonator 140 which is connected to one side of dual capacitors 144, the other sides being connected to ground. The pulses 60 provide the basis for the sequence of operation of the programmed events controlled by the microprocessor as well as the variable timing of asynchronous events. The microprocessor also includes a terminal or pin 145 connected to ground 107.

At the lower end of the charge coil 31, as at 131, the pulses $p_1$ and $p_2$ generated therein will manifest a polarity reversal, as shown in FIG. 3. As previously described, the main pulse 1 connected to charge the capacitor 94 while the side pulses $p_1$ and $p_2$ are used to charge capacitor 108. In that connection, it has been found advantageous to use the leading edges 56 and 57 of each of the pulses 55 (FIG. 2) to establish the basis or interval for sending out a signal to gate on the SCR 96 and thus cause the capacitor 94 to be discharged through the primary winding 33 of the ignition coil 34. An ignition pulse 59 (FIG. 2) will thus be generated in the secondary coil 34.

Since microprocessors are quite sensitive to "noise" caused by high energy electrical pulses particularly when generated in close proximity to the microprocessor which can adversely affect the operation and accuracy of the microprocessor, it is important to protect the microprocessor from the adverse affects of such high energy interference. Indeed, the '831 Patent, referred to above, provided an opto-coupler to protect the microprocessor from the feedback of the high flow of energy through the SCR. While it is understood that the opto-coupler served its intended purpose, the costs of using such an expensive component in this system, in the neighborhood of 40 cents per opto-coupler, was of such a high proportion to the overall materials costs of the system that the solution was not satisfactory from the standpoint of marketing, for small engine applications, ignition systems at competitive prices. With the present system, however, we have been able to accomplish the same result as that of the '831 Patent but at essentially no additional cost over the basic system.

This objective was accomplished by programming the microprocessor to command the "shut-down" or "cut-off" all its input ports for the duration of the ignition pulse 59 across the spark plug 37 of the ignition system. During the generation of the ignition pulse, the noise of this high energy pulse 59 would be picked up by the microprocessor and adversely affect its operation. To avoid this interference affect, the microprocessor has been programmed to issue a command which turns "off" all the input ports of the microprocessor for at least the duration of the high energy ignition pulse or preferably for substantially a longer time than the duration of the ignition pulse 59. As previously discussed, this command signal may be issued either prior to or after the output signal 64, which turns "on" the SCR 96, as long as it is prior to the generation of the ignition pulse 59. Moreover, during the time that the microprocessor input ports are turned "off", the voltage level at output terminal 111 may be maintained at such a high voltage in the neighborhood of 5 volts that it will not be capable of receiving the interference noise from the ignition system for generation of an AC ignition pulse resulting from the use of diode 104 which provides a ring-back path between the primary coil 33 and the capacitor 94. Alternatively, in a comparable system but one which utilizes a DC ignition pulse, the terminal may also be programmed to "cut-off" all ports of the microprocessor 90 after the pulse 64 has been sent out to gate "on" the SCR 96. This alternative would be feasible in such a system, since the SCR once triggered to its conductive mode will remain "on" until a reverse bias occurs across the anode/cathode junction of the SCR. Unlike the AC spark with its ring-back path in which the charge on the capacitor 94 is reversed with each ting-back of the primary coil, the DC spark with no ring-back path, will result in essentially the full discharge of the capacitor 94 before the SCR would be reversed biased.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described our invention, what is claimed is:

1. In a capacitor discharge ignition system having an ignition system for an internal combustion engine which includes a permanent magnet group rotatable with the engine for generating pulses in a charge coil disposed on a leg portion of a ferromagnetic core and also having a primary winding and secondary winding of an ignition coil disposed on the same leg portion of said core and having a microprocessor disposed in close proximity with the ignition coil, the improvement comprising means for energizing the microprocessor by said pulses generated in the charge coil during each revolution of the engine shaft, means for amplifying and squaring the leading edge portions of said pulses and connecting the same to the input port of the microprocessor for determining the elapsed time occurring in the time interval between said leading edges, an output port of the microprocessor being connected to a gate electrode of a silicon controlled rectifier (SCR) for switching the SCR "on" in response to a predetermined spark advance programmed into the microprocessor and said elapsed time indicative of the rotational speed of the engine, and said program including a signal to turn "off" all input ports of the microprocessor for a time at least as long as the spark duration of the ignition system whereby the microprocessor is isolated from any interference caused by the ignition pulse being generated in the secondary winding of the ignition coil.

2. In a capacitor discharge ignition system, as set forth in claim 1, in which the improvement comprises a transistor for amplifying and squaring the leading edge portions of said pulses and in which the program of the microprocessor includes a plurality of straight line segments, approximating a timing advance rotational speed curve for said internal combustion engine, each segment representing a portion of said curve for providing a predetermined spark advance for each said segment based upon the predetermined of numbers of timing pulses counted by the microprocessor during each interval of time between adjacent pulses of the same polarity generated by the charge coil.

3. In a capacitor discharge ignition system, as set forth in claim 2, in which improvement comprises a ceramic resonator connected to the microprocessor for providing time based clock pulses for the operation of the microprocessor.

4. In a capacitor discharge ignition system, as set forth in claim 3, in which the means for energizing the microprocessor includes means for resetting the microprocessor including a resistor and capacitor time-delay network to ensure that a second capacitor in the system is charged to its full potential value.

5. In a capacitor discharge ignition system, as set forth in claim 4, in which the output from the microprocessor which controls the operation of the SCR includes a Zener diode connected to ground and a resistor which protects the microprocessor and the gate of the SCR against excessively high voltages.

* * * * *